United States Patent [19]

Smith

[11] Patent Number: 4,901,380

[45] Date of Patent: Feb. 20, 1990

[54] KNOCKDOWN BATHING ENCLOSURE

[75] Inventor: Iain M. Smith, Vernon, Canada

[73] Assignee: Kohler Ltd./Ltee, Toronto, Canada

[21] Appl. No.: 303,255

[22] Filed: Jan. 30, 1989

[51] Int. Cl.[4] ..... A47K 3/22

[52] U.S. Cl. ..... 4/596; 4/612; 4/614; 52/34; 52/35; 52/79.1

[58] Field of Search ..... 4/596, 584, 599, 460, 4/600, 612, 614, 663, 664, 661; 52/34, 35, 79.1, 79.7, 79.9, 79.13, 173 R, 288, 466, 468, 584–586

[56] References Cited

U.S. PATENT DOCUMENTS

| | | | |
|---|---|---|---|
| 1,038,874 | 9/1912 | Goodsir Jr. | 428/61 |
| 1,366,955 | 2/1921 | Schneible | 220/5 A |
| 2,220,482 | 11/1940 | Fuller | 4/663 X |
| 3,288,427 | 11/1966 | Pluckebaum | 52/584 X |
| 3,382,635 | 5/1968 | O'Gara et al. | 4/612 X |
| 3,386,221 | 6/1968 | Giovannucci | 52/586 |
| 3,533,200 | 10/1970 | Zoebelein | 52/35 |
| 4,080,710 | 3/1978 | Hess | 29/416 |
| 4,169,688 | 10/1979 | Toshio | 52/586 X |
| 4,384,377 | 5/1983 | Calvert et al. | 4/614 |
| 4,423,528 | 1/1984 | Wiedmeir et al. | 4/613 |
| 4,471,501 | 9/1984 | Heymann | 4/599 |
| 4,553,276 | 11/1985 | Paradis | 4/612 |
| 4,578,832 | 4/1986 | Primucci | 4/614 |
| 4,691,392 | 9/1987 | Whitney | 52/35 X |

FOREIGN PATENT DOCUMENTS 1211905 9/1986 Canada .

OTHER PUBLICATIONS

Fiat Products Ltd., "The 1-2-3 Renovators" Advertisement.

*Primary Examiner*—Henry K. Artis

*Attorney, Agent, or Firm*—Quarles & Brady

[57] ABSTRACT

A knockdown type bathing enclosure is disclosed. It can be manufactured as a one-piece plumbing fixture, cut into portions for transportation, and assembled at the installation site. The bathing enclosure has a joining strip attached to an external side of a wall structure. The joining strip has an attachment surface for abutting the wall structure, and an outer tubular bulge. The joining strip and the wall structure are cut into portions along a plane passing through the tubular bulge. A plurality of locator members are then inserted into an internal slot formed in each portion of the cut tubular bulge. Guided into proper alignment by the locator members, the cut portions are then fastened together using a clamp member.

5 Claims, 3 Drawing Sheets

KNOCKDOWN BATHING ENCLOSURE

BACKGROUND OF THE INVENTION

This invention relates to bathing enclosures. More particularly, it pertains to bathing enclosures that can be divided into portions and subsequently reassembled, and also to a method for accomplishing the same.

The term bathing enclosure encompasses a wide variety of plumbing fixtures. Bathtubs and showers are familiar types of bathing enclosures. However, whirlpools, spas, saunas, and environmental enclosures are other plumbing fixtures that are "bathing" enclosures. In many modern designs, these bathing enclosures are molded from fiberglass or other materials into one-piece plumbing fixtures.

One-piece plumbing fixtures are advantageous for a variety of reasons. In production, manufacturing a single piece as compared to several can result in substantial efficiencies. In installation, one-piece units do not require coordinating part sizes as do units having several components. Also, assembling multiple-piece units may require a significant amount of time and manpower.

The main disadvantage of one-piece units, however, is their size. When installing such a bathing enclosure in a new building, there may not be sufficient space to introduce a relatively large one-piece unit. Similarly, when remodeling an older building doorways and halls frequently provide insufficient space to permit the entry of one-piece bathing enclosures. Because removing building walls is generally not an acceptable solution, one-piece bathing enclosures are sometimes cut into two or more portions. The portions are transported through the small entrance ways and then reassembled. U.S. Pat. No. 4,578,832.

Assembling the cut portions of a bathing enclosure has presented some difficulties. Most systems use bolts that fit through holes on extensions on the back of the enclosure. The holes must be aligned before this can be done. This may be difficult and/or time consuming.

Other designs (e.g., U.S. Pat. No. 4,080,710) modify the bathing enclosure shape to include wall segments that overlap when the walls are reconnected. This method results in a loss of height in the unit. In order for all installed bathing enclosures to be the same height, a manufacturer using this system must therefore use two molds, one to produce units that are directly installed and the other to produce units that are cut and reassembled.

Thus, it can be seen that an improved knockdown type bathing enclosure is needed.

SUMMARY OF THE INVENTION

This invention provides a method of forming a bathing enclosure. A wall structure is formed with the rear wall and two side walls. A joining strip is then attached on an external side of the wall structure. The joining strip has an inner attachment surface for abutment against the external side of the wall structure, an outer tubular hollow bulge, and outer clamp abutment surfaces on the tubular bulge. The wall structure and the joining strip are then cut along a plane so as to create a first enclosure portion and a second enclosure portion.

In this way, both of the enclosure portions have affixed to them a part of the tubular bulge that has a clamp abutment surface and an internal slot. Both of the slots are formed from a portion of the tubular hollow bulge, run along the strip (as opposed to just transversely through as in the case of conventional bolt holes), and are open in the direction of the plane of the cut. A locator member is inserted inside both the first enclosure portion slot and the second enclosure portion slot so as to align the upper and lower enclosure portions with respect to each other. Using a clamp member that abuts against the clamp abutment surfaces, the first and second enclosure portions are fastened together. This aspect of the invention provides a simplified method of cutting a bathing enclosure to enable the unit to be transported through a small area, and then rebuilding the portions for installation. The cut portions are easily aligned due to the presence of the locator members (the locator members can be positioned almost anywhere along the slots on each side) and the absence of bolts requiring alignment in bolt holes.

In another aspect of the invention, sealant is applied to the cut edges of the plumbing fixture wall structure prior to fastening the first and second enclosure portions together. This aspect aids in providing a watertight seal between the first and second portions.

This invention also provides a bathing enclosure or the like having a multi-piece plumbing fixture wall structure with a first portion and a second portion. The first portion has walls with edges which can be substantially aligned with opposed edges of the walls of the second portion, thereby defining a seam between the first and second portions. A first joining strip and a second joining strip are attached to the external side of the wall structure. The joining strips have an inner attachment surface for abutment against the external side of the wall structure. The joining strips also have an outer bulge with a slot, and an outer clamp abutment surface on the bulge. The slots are formed so as to run along the strip.

One of the joining strips is affixed to the first wall structure portion, and the other joining strip is affixed to the second wall structure portion. The strips are affixed adjacent to the seam such that the slots face each other and define a tubular inner hollow. A locator member is positioned inside the hollow so as to assist in the alignment between the first and second portions during assembly of these portions. Preferably, it is inserted along the seam. A clamp member, abutting the clamp abutment surfaces, is used to fasten the first and second enclosure portions together. Note that the bathing enclosure is formed by cutting a single structure into smaller portions, and it can then be quickly reassembled. This can be achieved without a loss of height of the bathing enclosure.

In another aspect of the invention, an inward wall of the joining strip extends either above or below one of the bulges to form an attachment extension. This aspect of the invention provides a larger surface for attaching the joining strip to the external side of the wall structure. The attachment extension can contain a through hole that can be filled with adhesive. This aspect provides a stronger bond between the joining strip and the external side of the wall structure.

In another aspect of the invention, the inward wall of the joining strip has a surface which is corrugated. This further strengthens the bond between the joining strip and the external side of the wall structure.

Thus, it is an object of the present invention to provide a system which allows cutting and convenient reassembly of a bathing enclosure so that is can be used in an area having small doors or passageways.

It is another object of the invention to provide a simplified method of reconstructing a cut bathing enclosure that does not require bolts to be aligned and inserted into transverse bolt holes formed in the enclosure walls.

It is another object of the invention to provide a bathing enclosure that can be cut and reassembled without a loss of height of the bathing enclosure.

It is still another object of the invention to provide a method of reassembling the cut portions of the bathing enclosure that permits easy alignment of the upper and lower portions.

It is yet another object of the invention to provide a bathing enclosure that has a secure water-tight seam.

The foregoing and other objects and advantages of the invention will be evident from the following description. In the description, reference is made to the accompanying drawings which form a part hereof, and in which there is shown by way of illustration preferred embodiments of the invention. Such embodiments do not necessarily represent the full scope of the invention. Reference is therefore made to the claims herein for interpreting the scope of the invention.

DETAILED DESCRIPTION OF THE PREFERRED EMBODIMENTS

Figure 1:
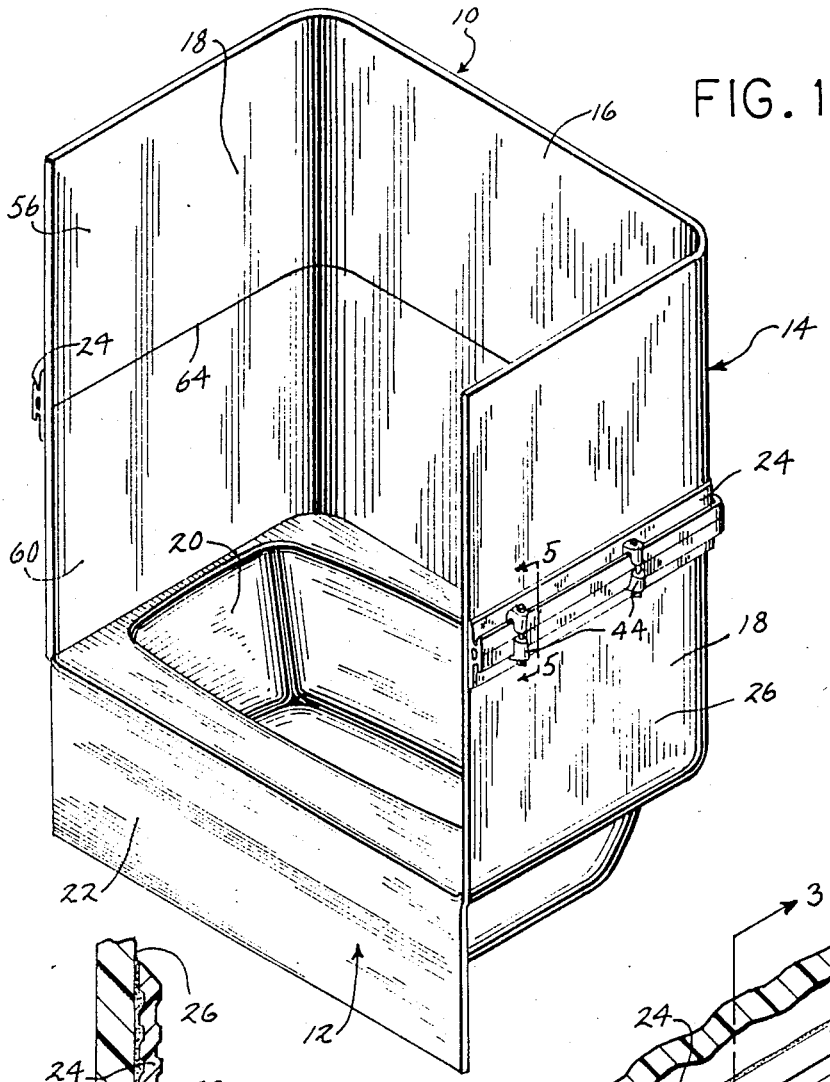
FIG. 1 is a view in perspective of an assembled bathing enclosure in accordance with the present invention.

A bathing enclosure 10 is shown in FIG. 1. It has a bathtub portion 12 which is surrounded on three sides by a wall structure 14. The wall structure 14 consists of a rear wall 16 and two side walls 18. Note also the usual basin 20 and apron 22.

Figure 3:
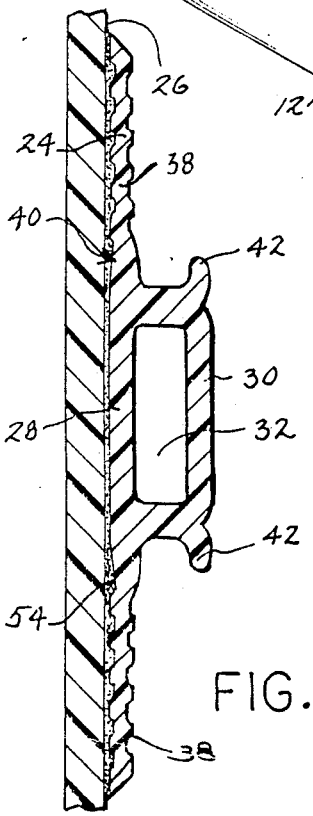
FIG. 3 is a view in vertical section taken on line 3—3 of FIG. 2.
Figure 2:
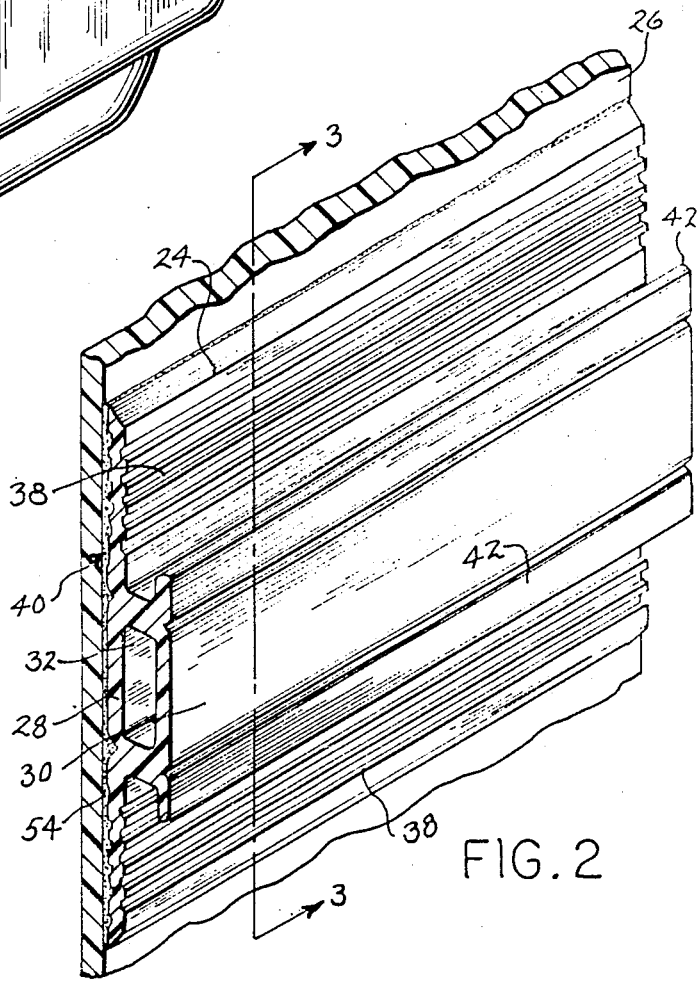
FIG. 2 is a view, in perspective, of part of a joining strip shown attached to the external side of the wall structure of the bathing enclosure before the enclosure has been cut into two pieces.

A joining strip 24 according to the present invention is shown in FIG. 2. The joining strip 24 is preferably extruded from a PVC material and adapted to fit against an external side 26 (FIGS. 1 and 2) of the wall structure 14. The joining strip 24 has an inward wall 28 and an outer tubular bulge 30 (best shown in FIGS. 2 and 3). The tubular bulge 30 defines a tubular hollow 32 which extends the length of the joining strip 24.

Figure 4:
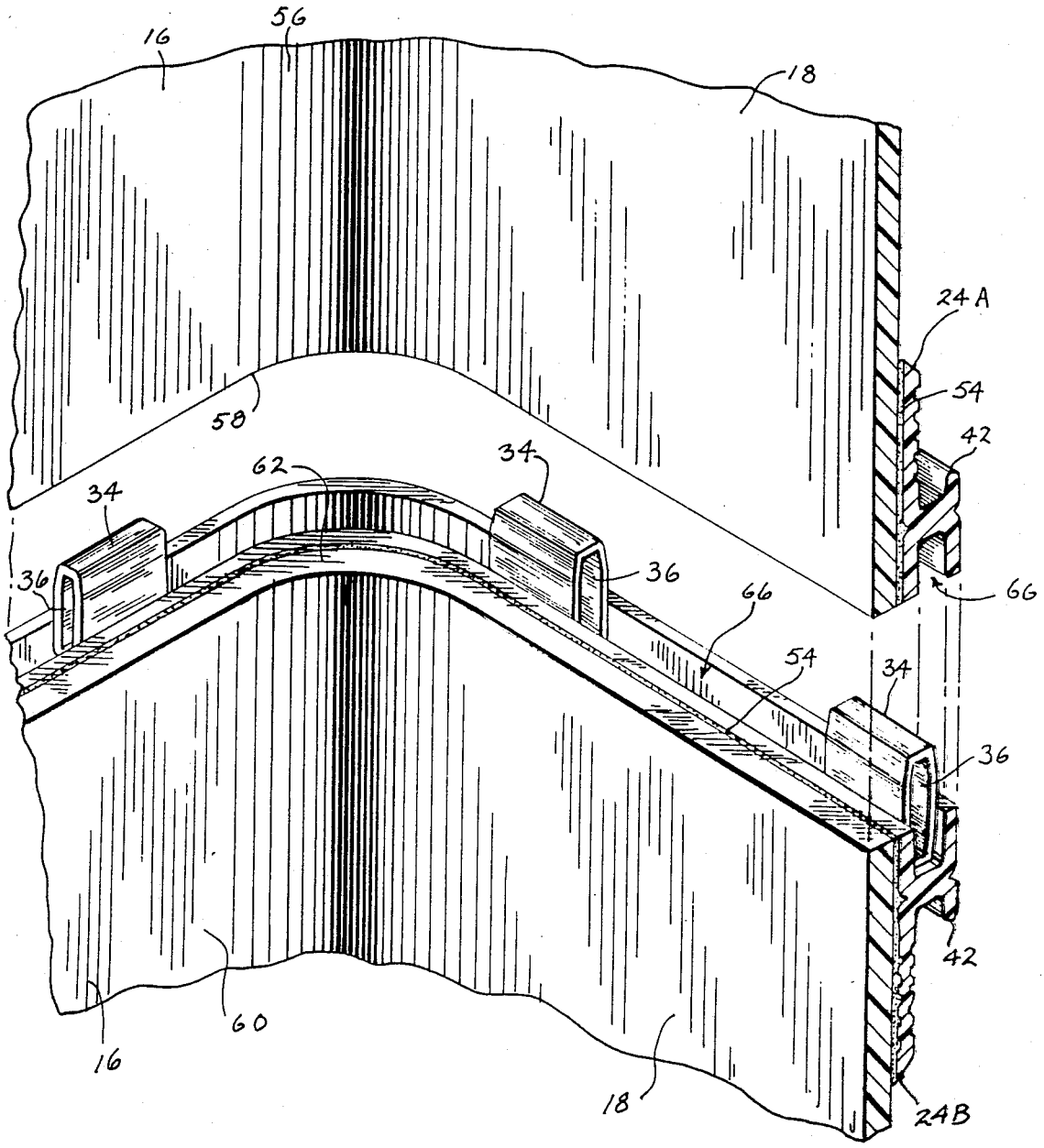
FIG. 4 is a view in perspective of the upper and lower portions of the bathing enclosure and showing locator members positioned inside the lower slot.
Figure 5:
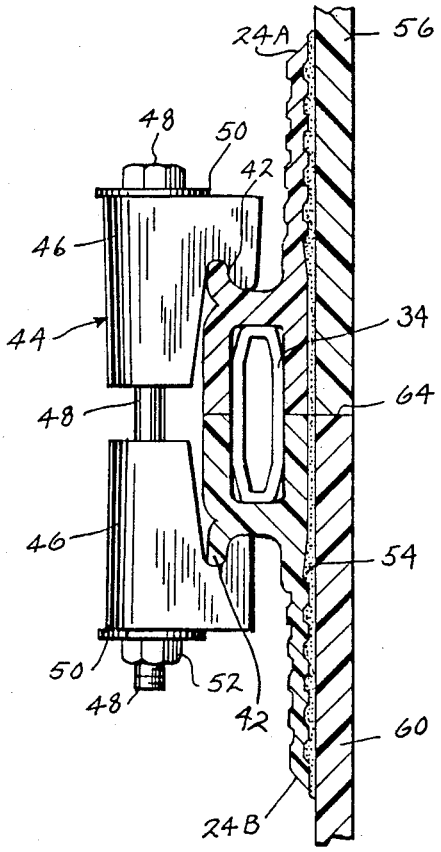
FIG. 5 is an enlarged view in vertical section taken along line 5—5 in FIG. 1.

Locator members 34 (FIGS. 4 and 5) are shaped to tightly wedge within the tubular hollow 32 of the joining strip 24. They may be formed by extruding a PVC material similar to that used for the joining strip 24, and then cutting the material into appropriate lengths. Preferably, each locator member 34 is one inch long and is positioned inside the tubular hollow 32 approximately three inches from the closest neighboring locator member. Although the locator members 34 shown in FIGS. 4 and 5 have a central cavity 36, their exact shape may vary. For instance, the locator members 34 could incorporate a cross member (not shown) for support, or even be solid.

The inward wall 28 of the joining strip 24 extends in a plane both above and below the tubular bulge 30 to form attachment extensions 38 (best shown in FIG. 2). The inner wall 28 and the attachment extensions 38 together form inner attachment surface 40.

Opposite the attachment extensions 38 and extending outward from the tubular bulge 30, are two clamp abutment surfaces 42. Like the tubular bulge 30, the clamp abutment surfaces 42 extend the length of the joining strip 24. The clamp abutment surfaces 42 permit a plurality of clamp members 44 (FIG. 5) to be easily attached to the joining strip 24. The clamp members 44 each have two hook-type clamp heads 46 which are adapted to engage the clamp abutment surfaces 42 of the joining strip 24. A bolt 48 is inserted through a pair of washers 50 and the clamp heads 46, and is threadably secured to a nut 52. The clamp members 44 are positioned at intervals along the joining strip 24.

The inner attachment surface 40 of the joining strip 24 is secured to the external side 26 of the wall structure 14 by an adhesive 54. The bond between the wall structure 14 and the joining strip 24 is strengthened by forming the inner attachment surface 40 in a corrugated shape. The joining strip 40 is positioned preferably, but not necessarily, horizontally on the bathing enclosure 10. The joining strip 40 can be formed with curves to correspond to the corners between the side walls 18 and the rear wall 16 of the bathing enclosure 10. Otherwise, three lengths of joining strips (not shown) could be positioned on each of the side walls 18 and on the rear wall 16 in a horizontal plane.

After the joining strip 24 has been secured to the external side 26 of the bathing enclosure 10, the wall structure 14 and the joining strip 24 are cut in a plane passing through the tubular hollow 32 of the joining strip 24. The joining strip 24 and the wall structure 14 may be cut by any suitable means, such as by a band saw. The cut forms an upper first enclosure portion 56 having a seam edge 58, and a lower second enclosure portion 60 having a seam edge 62 (shown in FIG. 4). The seam edges 58 and 62 create a seam 64 (FIG. 5) between the upper and lower enclosure portions 56 and 60. The cut also forms a first joining strip 24A and a second joining strip 24B. The first joining strip 24A remains secured to the first enclosure portion 56, and the second joining strip 24B remains secured to the second enclosure portion 60.

The first and second enclosure portions 56 and 60, being smaller than the entire bathing enclosure 10, can then more easily be transported to the final installation site. More than one cut may be made if smaller portions are necessary due to the presence of very narrow entrance ways. When the portions have been transported to the final installation site, the portions are reunited.

Note that by cutting through the tubular hollow 32, an internal slot 66 (FIG. 4) is formed in each of the joining strips 24A and 24B. The first enclosure portion 56 is then lowered onto the second enclosure portion 60. The locator members 34 (and especially their tapered upper sides) serve to guide the enclosure portions 56 and 60 together so that the edges 58 and 62 are aligned into their original position. A sealant (not shown), such as Versilok (an acrylic adhesive produced by Lord Chemical), may be applied to the upper and lower edges 58 and 62 before the portions 56 and 60 are reunited. The clamp members 44 are then fastened to the clamp abutment surfaces 42 of the joining strip 24 at regular intervals and in sufficient quantity to secure the first and second enclosure portions 56 and 60 together.

Thus, this method allows a one-piece bathing enclosure 10 to be cut into two (or more) portions so that it can be transported through hallways and doors. Once the bathing enclosure arrives at the installation site, it can be reassembled. The height of the bathing enclosure 10 is not changed since the sealant replaces essentially the same height as was lost due to the thickness of the saw blade. Further, the system allows the cut bathing enclosure 10 to be reassembled without having a difficult alignment of bolts and bolt holes. The exact placement of the locators along the slots is not critical and similarly the clamps need not be postured at exact places along the outside flange. Thus, reassembly is made much easier in cramped quarters.

Figure 6:
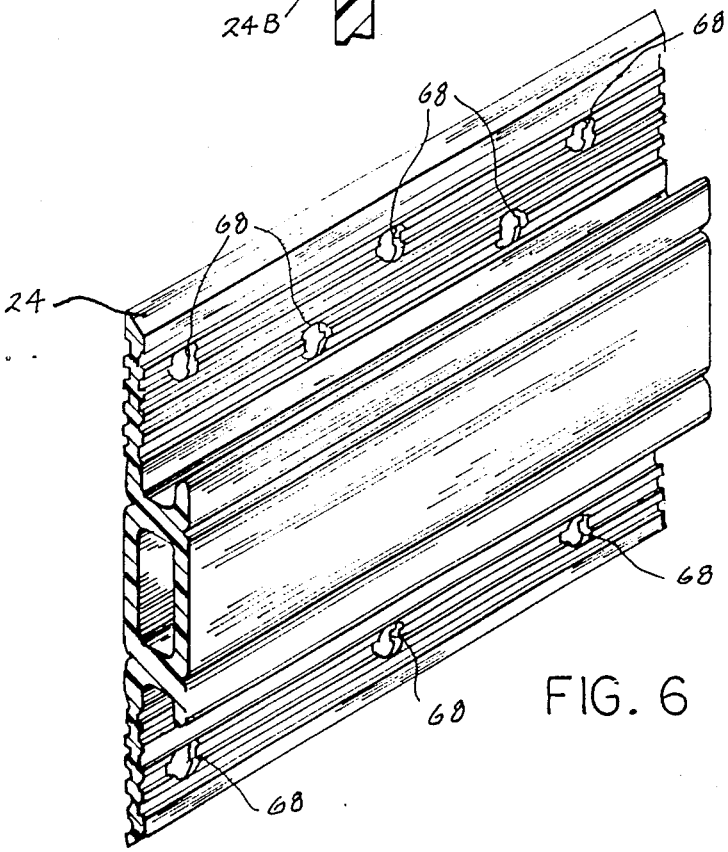
FIG. 6 is a view in perspective showing another embodiment of the joining strip.

Another embodiment of the invention is shown in FIG. 6. The joining strip 24 is provided with a plurality of through holes 68. The holes 68 assist in securing the joining strip 24 to the external wall 26 of the bathing enclosure 10. The adhesive 54 fills the holes 68, as well the area between the inner attachment surface 40 and the external wall 26, thereby improving the bond between the surfaces.

The foregoing detailed description has been for the purpose of illustration. Thus, a number of modifications and changes may be made without departing from the spirit and scope of the present invention. For example, the clamp member 44 could be modified, such as by incorporating an elastic member or a screw rather than the bolt 48. Therefore, the invention should not be limited by the specific embodiments described, but only by the claims.

I claim:

1. A bathing enclosure, comprising:

a multi-piece plumbing fixture wall structure having a first portion and a second portion, said first portion having walls with edges which can be substantially aligned with opposed edges of walls of the second portion so as to define a seam;

a first joining strip and a second joining strip, both of said joining strips being attached on an external side of the wall structure and having an inner attachment surface for abutment against said external side, an outer bulge with a slot therein, and an outer clamp abutment surface on said bulge;

the slots being formed so as to run along the strip;

one of said joining strips being affixed to the first wall structure portion and the other of said joining strips being affixed to the second wall structure portion, said strips being both affixed adjacent said seam such that the slots face each other so as to define a tubular internal hollow;

a plurality of locator members selectively positionable inside the hollow so as to assist alignment between the first and second portions;

a clamp member for fastening together the first and second enclosure portions by abutting against the clamp abutment surfaces; and wherein an inward wall of a joining strip extends above, or below one of said bulges to form at least one attachment extension that is suitable to assist in attaching a joining strip on the external side of the wall structure.

2. The enclosure of claim 1, wherein the first portion is an upper portion with two side walls and a rear wall, and the second portion is a lower portion with two side walls, a rear wall, and a bottom wall.

3. The enclosure of claim 1, wherein an inward wall of a joining strip has a surface which is corrugated.

4. The enclosure of claim 1, wherein the attachment extension contains a through hole that is filled with adhesive.

5. The enclosure or the like of claim 1, wherein the clamp member has a bolt and two hook-type clamp heads.

* * * * *